US006786252B2

(12) United States Patent
Erb et al.

(10) Patent No.: US 6,786,252 B2
(45) Date of Patent: Sep. 7, 2004

(54) MACHINE FOR FILLING BAGS OR THE LIKE COMPRISING A CONTROL DEVICE WITH CAMS

(75) Inventors: René Erb, Phalsbourg (FR); Ferdinando Bertolotti, Crema (IT)

(73) Assignee: Flextainer (Societe Anonyme), Schalbach (FR)

( * ) Notice: Subject to any disclaimer, the term of this patent is extended or adjusted under 35 U.S.C. 154(b) by 0 days.

(21) Appl. No.: 10/730,111

(22) Filed: Dec. 9, 2003

(65) Prior Publication Data

US 2004/0112459 A1 Jun. 17, 2004

(30) Foreign Application Priority Data

Dec. 9, 2002 (FR) ..... 02 15538

(51) Int. Cl.[7] ..... B65B 1/04

(52) U.S. Cl. ..... 141/129; 141/114; 141/144; 53/384.1; 53/75; 53/381.4

(58) Field of Search ..... 141/10, 313–319, 141/114, 129, 144–149; 53/381.4, 382.1, 384.1, 385.1, 386.1, 75, 564, 570, 573

(56) References Cited

U.S. PATENT DOCUMENTS 3,112,777 A 12/1963 Lohse
4,108,221 A 8/1978 Freimuth et al.
4,171,933 A 10/1979 Freimuth et al.
4,283,901 A 8/1981 Schieser et al.
4,297,929 A * 11/1981 Schieser et al. ..... 83/110
6,701,697 B2 * 3/2004 Savigny et al. ..... 53/570
2001/0025669 A1 10/2001 Shoji

FOREIGN PATENT DOCUMENTS

EP 1 145 955 10/2001

* cited by examiner

*Primary Examiner*—Steven O. Douglas
(74) *Attorney, Agent, or Firm*—Young & Thompson

(57) ABSTRACT

A machine for filling bags with comestible liquids, includes a transfer station rotatable about a vertical central axle mounted on a plate secured to the machine frame, multiple filling stations each comprising an element for gripping and holding the base of a removable closure for a bag and an element for manipulating the upper portion of the closure, and a filling device coacting with the opening of the open closure following removal of its upper portion and supplied with liquid by a pump connected to a reservoir, the assembly of these elements being managed by a control device. The control device is a device with cams mounted fixedly on the machine. The invention is more particularly applicable to the field of packaging and dispensing of liquids, in particular comestible liquids, in small flexible receptacles.

18 Claims, 4 Drawing Sheets

MACHINE FOR FILLING BAGS OR THE LIKE COMPRISING A CONTROL DEVICE WITH CAMS

The present invention relates to the field of packaging and dispensing of liquids, in particular comestible liquids, in small flexible receptacles, these receptacles being provided for this purpose with valves, closures such as corks or any other accessory for dispensing and withdrawing, and has for its object a machine for filling bags or the like comprising a control device with cams.

At present, the packaging and dispensing of certain comestible beverages, particularly table wines, fruit juices or pasteurized milk, takes place by means of flexible receptacles, such as bags of synthetic material, commonly called bag in box, generally provided with valves or outlet opening of these receptacles.

These bags are made from multi-layer films generally comprising a barrier layer arranged between sealing and internal and external protective layers, then packaged under vacuum in cardboard boxes for assembly and dispatched toward their filling destination. This manner of procedure permits rapid production of bags, as well as good quality control.

Recent commercial developments tend to limit the number of intermediate steps between the production of the liquid and its sale, for the purpose of reducing costs connected with handling, transport or bulky empty containers and storage. To this end, it has been proposed to carry out simultaneously the production and filling of bags at a single production site, the filled bags being then sent to the sales and/or consumption outlets. Such an arrangement of packaging and distribution requires the use of specific installations, in which the production and filling of the bags are carried out simultaneously.

These known installations therefore permit satisfying the new requirements as to packaging material of liquid products. However, in these known installations, the filling machine is subjected to very great stresses which are prejudicial to reliable high speed operation.

Thus, the filling machines of these installations are generally multiple filling station machines individual to the bags, of which each station comprises an assembly of means permitting securing and holding the bag, manipulation of the closure to permit filling of said bag, then the filling of the latter, closing of the bag and its evacuation for packaging. The different operations carried out by these filling machines are all controlled and monitored by means of a control device with pneumatic jacks and monitoring with position and/or electrical or opto-electrical position and/or end of course detectors.

As a results the control and monitoring device is particularly complicated and its installation and maintenance are relatively costly. Thus, because these machines carry out a large number of unit operations per hour, the jacks with which they are provided are subjected to a very stressful mode of operation, such that their replacement after wear must be envisaged with relatively short delays, which gives rise on the one hand to corresponding stoppages of the machines and on the other hand increasing production costs.

Moreover, the operation of the present machines gives rise to a large consumption of energy, in particular because of the transformation of electrical energy necessary for the production of pneumatic energy, which is not recyclable, as well as for overcoming the effect of friction and inertia of the masses of the machine during the successive negative and positive acceleration phases.

It should also be noted that these machines must have a synchronous type operation, which gives rise necessarily to relatively long cycle times and hence a relatively low output.

The present invention has for its object to overcome the drawbacks of the bag filling machines known at present, by providing a filling machine of this type comprising a device with cam control permitting a simplification of the construction, better reliability of operation and simplified maintenance giving rise to lower cost of production of the machine and production of filled bags.

To this end, the machine for filling bags or the like, in particular with comestible liquids, which is essentially constituted by a transfer station rotatable about a central vertical axis mounted on a plate secured with the frame of the machine, with multiple filling stations each comprising a means for gripping and holding the base of a disassembleable closure for a bag and a means for manipulating the upper part of said closure, and by a filling device coacting with the opening of said open closure following disassembly of the upper portion of this latter and supplied with liquid by a pump connected to a reservoir or the like, the assembly of these elements being controlled by a control device, is characterized in that the control device is a device with cams mounted fixedly on the machine.

The invention will be better understood from the following description, which relates to a preferred embodiment, given by way of non-limiting example, and explained with reference to the accompanying schematic drawings, in which.

Figure 1:
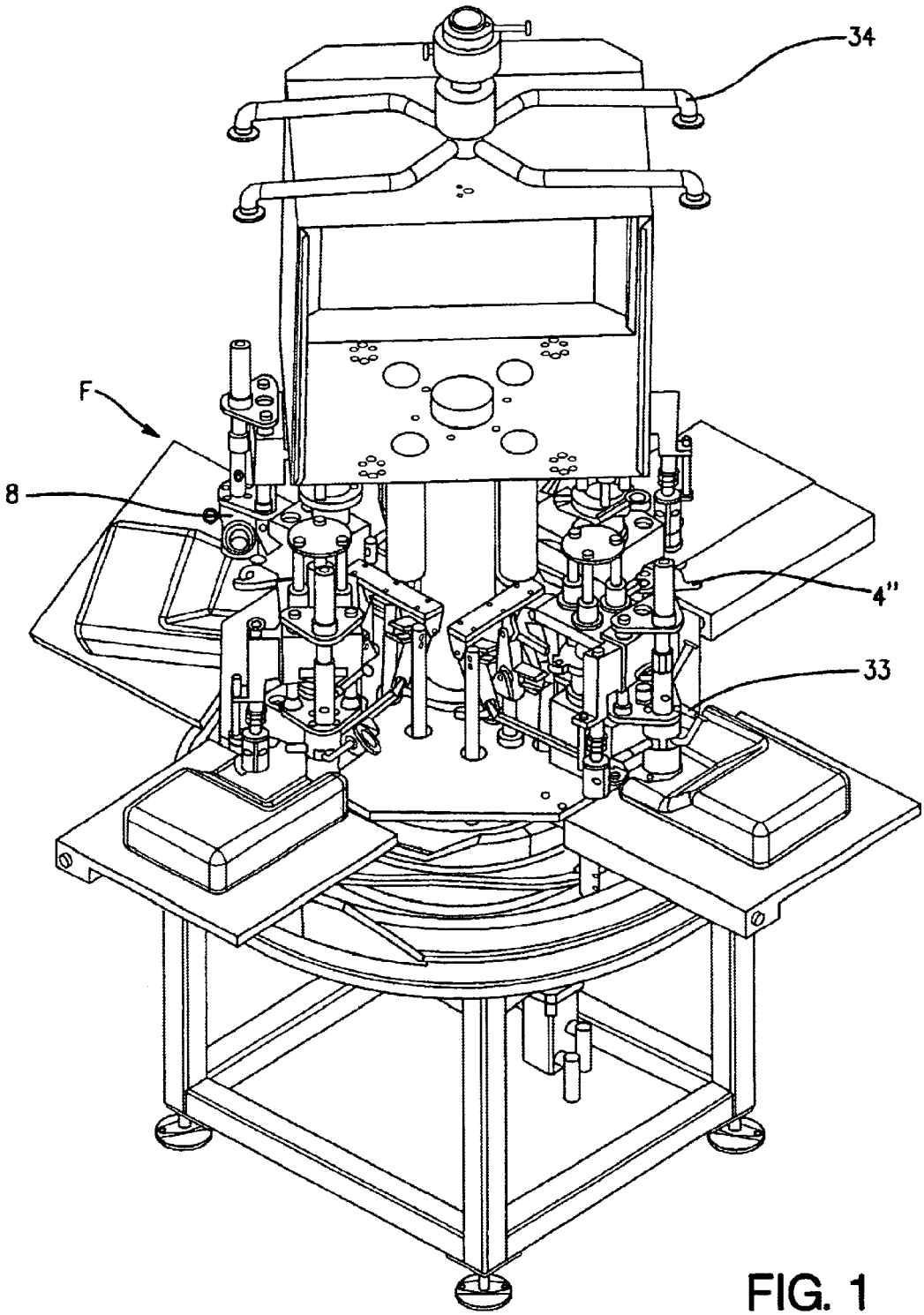
FIG. 1 is a schematic perspective view, partially broken away, of a filling machine according to the invention.

FIGS. 1 to 4 of the accompanying drawings show a machine for filling bags or the like, in particular with comestible liquids, which is essentially constituted by a transfer station 1 rotatable about a central vertical axle 2 mounted on a plate secured to the frame of the machine, by multiple filling stations 3 each comprising a means 4 for gripping and holding the base of a removable closure 5 of a bag 6 and a means 7 for manipulation of the upper part of said closure, and by a filling device 8 coacting with an opening of said closure 5 that is open following the removal of the upper portion of this latter and supplied with liquid by a pump connected to a reservoir or the like, the assembly of these elements being operated by a control device.

According to the invention, the control device of the filling machine is a device with cams 9 to 14 mounted fixably on the machine. These cams 9 to 14, adapted to actuate the different elements of the machine, are mounted concentrically about the central vertical axle 2 on a plate 2' secured to the frame of the machine and disposed below the rotatable transfer station 1.

Moreover, according to another characteristic of the invention, the cams 9 to 14 are preferably mounted angularly adjustably on the plate 2' secured to the frame of the machine, by co-action with a corresponding lower annular support (not shown) secured to said plate 2', the holding in position, after adjustment, of the cams 9 to 14 being ensured by means of screws passing vertically through said cams and co-acting with their annular support or lateral screw grippers. The annular supports of the cams 9 to 14 as well as the means for securement of these latter on said supports are not shown in detail in the accompanying drawings, being of simple construction, easily understandable to those skilled in the art.

Thus it is possible to adjust precisely the different movements of the elements to be controlled by the cams and more particularly the beginning and end of the action of said cams.

In this way, the operation of the filling machine can be guaranteed with high flexibility, to the extent to. which the beginning and end of the execution of the different movements by the control elements can be adjusted as desired, as a function of specific needs.

Each filling station 3 is constituted by a pivotable head 29, mounted on a vertical axle 3', guided in the rotatable transfer station 1 by means of a fixed support 3''', mounted on said station 1, said pivotable head 29 being provided with an eccentric actuating pivot 16 coacting with an assembly of pusher 11'—elbowed lever 11''—rod 11''' actuated by a cam 11 of the control device with cams. The elbowed lever 11'' is mounted pivotably on the transfer station 1 by means of a bearing 15 and is connected articulatedly by its two ends, respectively to one end of the pusher 11'' opposite the cam 11 and to one end of the rod 11''', which is mounted articulatedly on the eccentric actuating pivot 16 of the head 29 of the filling station 3.

The pusher 11' is guided on the transfer station 1 by means of a sleeve 18 secured to this latter and is provided at its end coacting with the cam 11 with a bearing roller 17, a spring 19 mounted concentrically on the pusher 11' between the sleeve 18 and a bearing shoulder or ring located adjacent the roller 17 ensuring permanent contact of this latter with the cam 11. Thus, in the course of rotation of the transfer station 1 with the filling stations 3, the heads 29 of these latter are actuated by pivoting between two end positions which are delimited by the profile of the cam 11. As described hereafter, these positions correspond respectively to removal and replacement of the closure before and after filling and to that of filling the bag.

The number of filling stations 3 is four in the accompanying drawings. However, this number can be different, the cams 9 to 14 simply taking account of the number of filling stations 3, so as to permit with one rotation of the cams about the axle 2, a complete cycle of operation of the stations 3.

The means 4 for gripping and holding the base of a removable closure 5 of a bag 6 of each filling station 6 is constituted by an assembly of left and right pinchers 4' and 4'' with a different actuation controlled respectively by cams 10 and 9 of the control device with cams, by means of pusher assemblies 10', 9'—elbowed lever 10'', 9''—rod 10''', 9'''. The elbowed levers 10'', 9'' are articulated on the transfer station 1 by means of respective bearings 23, 22 and the pushers 10'', 9'' are guided on this transfer station 1 by means of sleeves 21, 22, said pushers being moreover provided on the one hand each with a roller 27, 26 for bearing on the respective cams 10 and 9 and, on the other hand, with a compression spring 25, 24 bearing adjacent its end carrying the bearing roller and against the sleeve 21, 20. The articulated connection between the left and right pinchers 4' and 4'' and the rods 10''', 9''' is carried out in known manner by means of an eccentric pivot coacting with the corresponding end of the rod.

Thus, in the course of rotation of the transfer station 1, for holding and positioning a bag 6, one of the pinchers, namely the left pincher 4' is first of all pressed into its service position and partially surrounds the lower portion of the closure 5 of said bag 6 by bringing this closure into its definitive position of being raised and positioned in the upper portion, as well as for filling, then, in the course of continued rotation of the station 1, the other pincher, namely the right pincher 4', is brought to the service position, in which it seats the lower portion of the closure 5 against the left pincher 4', the holding of the lower portion of the closure 5 and hence of the bag 6 is ensured during all the duration of filling and up to the time of evacuation of the bag 6.

The means 7 for manipulation of the upper portion of the closure 5 is constituted by a sleeve 28 for gripping the upper portion of the closure 5 mounted on the head 29 of the filling station 3 with the possibility of slight movement parallel to the axle 3' for supporting the head 29. This sleeve 28 is mounted on the head 29 by means of a shock absorbing guide assembly 30 to 32 (FIGS. 3 and 4) constituted by a sliding axle 30 loaded by a spring 31 and by a guide rod 32 coacting with a corresponding guide of the head 29 and holding the latter against rotation about the axle 30.

The sleeve 28 is provided with at least two pinchers with opposed claws 28' each loaded by a return spring (not shown) in a closed position of the claws. The pinchers with claws 28' are adapted to grasp, by means of their claws, the lower edge of the upper portion of a closure 5, so as to permit its removal. A perfect operation of the sleeve 28 can thus be ensured because of the mounting of this latter on the head 29 with the possibility of slight movement in the direction of this latter by means of the shock absorbing guide assembly 30 to 32.

According to another characteristic of the invention, the axle 3' of each filling station 3, which is guided on the fixed support 3'' secured to the transfer station 1, passes through said transfer station 1 and coacts at its free end opposite the head 29 with an annular cam 12 of the control assembly with cams 9 to 14. To this end, the free end of the axle 3' is preferably provided with two guide lugs or rollers 3''' bearing on opposite sides of the annular cam 12.

Thus, during rotation of the transfer station 1, the axle 3', which coacts with the cam 12 by means of its lugs or rollers 3''', has a vertical rising and descending movement, by which it drives the head 29 and hence the sleeve 28.

To carry out removal of the upper portion of a closure 5, in the corresponding pivoting position of the head 29 of the station 3, following the actuation of this latter by means of the cam 11, the cam 12 actuates said head 29 with a descending movement having the result of applying the sleeve 28 of the means 7 for manipulation of the upper portion of the closure 5, to said closure 5 and to carry out a snapping of the claws of the pincher with claws 28' below the edge of said upper portion. It follows that, during consecutive rotation of the working station 1, that cam 12 presses the axle 3' for supporting the head 29 in the opposite direction and causes the removal of said upper portion of the closure, which remains held in the sleeve 28. The shock absorbing guide assembly 30 to 32 of the sleeve 28 permits ensuring with certainty the gripping of the upper portion of the closure, whilst avoiding crushing of the latter under the influence of the descending movement of the head 29.

Figure 2:
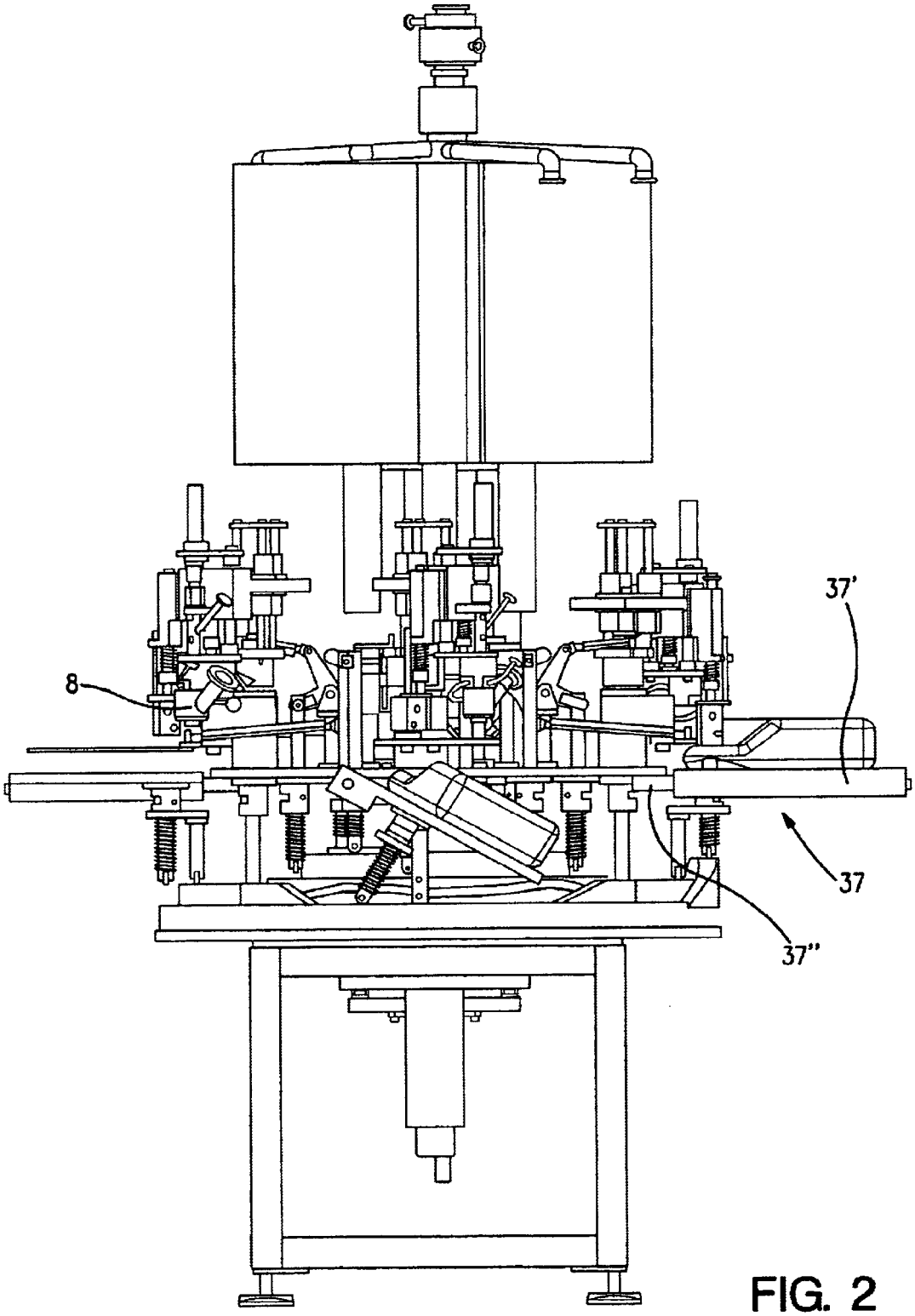
FIG. 2 is an elevational view in the direction F of FIG. 1.
Figure 4:
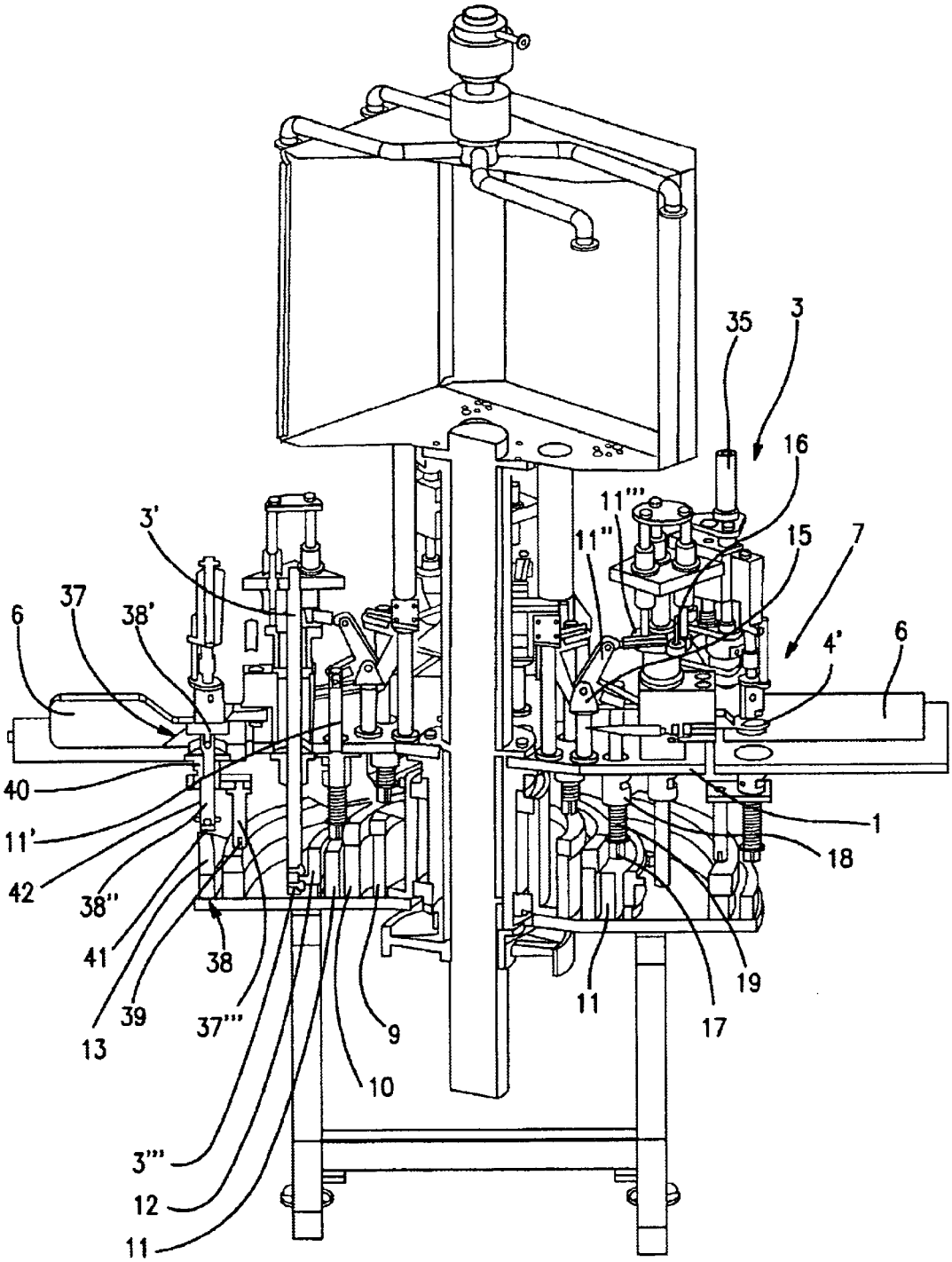

The filling device 8, coacting with the opening of the closure 5, is mounted on the movable head 29 of the station 3 and is movable pivotably, together with the means 7 for manipulating the upper portion of the closure 5, and is present in the form of a hollow body that can be applied in sealed relation against the lower portion of the closure 5, this hollow body being, on the one hand, connected by a connection 33 to a conduit 34 for connection to the filling pump connected to the reservoir and, on the other hand, provided with a closure means for the connection 33 controlled by a pneumatic jack 35 (FIGS. 1, 2 and 4).

Thus, after removal of the upper portion of the closure 5 by means of the sleeve 28 controlled by the cam 12, the head 29 of the station 3 is pivoted into the filling position for the bag 6 by the cam 11 and the filling device 8 is applied in sealed manner against the base of the closure 5 with a movement controlled by the cam 12.

A simple detection of this application by an end of path contact integrated with the device 8 permits actuating of the jack 35 for a time corresponding to the filling of the bag 6. This time can be exactly predetermined and controlled by a timer, which actuates the jack 35 for closing, at the end of filling.

Figure 3:
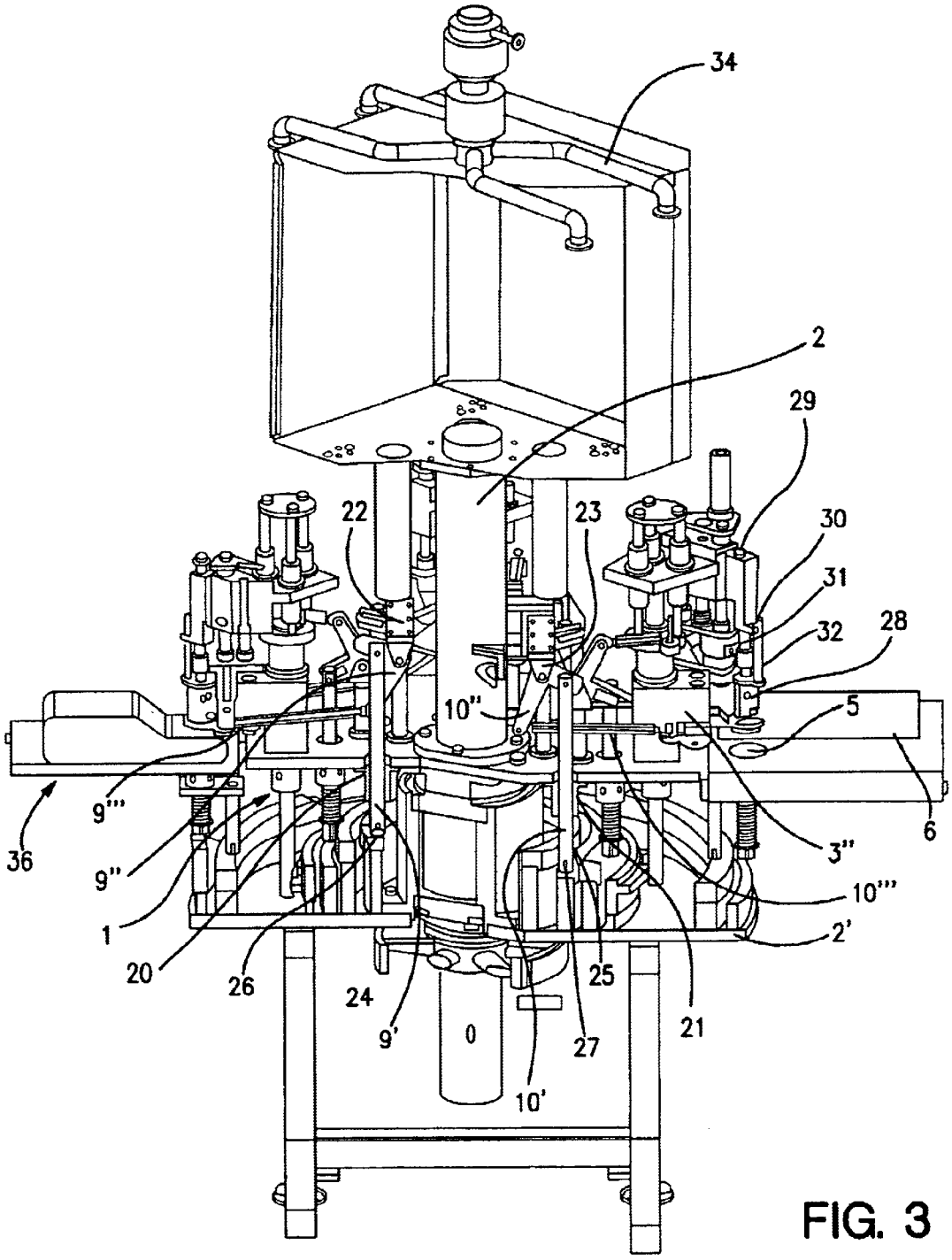
FIGS. 3 and 4 are perspective views, partially broken away, showing more particularly the control device in these different applications.

According to a characteristic of the invention, the transfer station 1 is provided, at the level of each filling station 3, with a means 36 for support, closure and evacuation of the bags 6, which is essentially constituted by a pivoting device 37 for reception of the bags coacting with a control cam 14 and an assembly 38 for closing the bags 6 after filling, coacting with a control cam 13 (FIGS. 3 and 4).

The pivoting device 37 for reception of the bags coacting with a control cam 14 is present in the form of a pivoting support plate 37' mounted articulatedly on the transfer station 1 by means of a pivotal shaft 37" and by an actuating arm 37'", secured to the pivoting support plate 37' and coacting at its free end by means of a roller 39 or the like, with the cam 14 of the control device with cams. Thus, the bag 6 can be deposited empty and flat, as shown in FIGS. 1 and 2 of the accompanying drawings, and be gripped in position, then filled to be finally discharged, after filling and returned into place of the closure, by being held flat during the operation of positioning, as well as during the filling and closing, a pivoting of the plate 37' taking place after said closure, when the actuating arm 37'" arrives on the corresponding profile of the cam 14. Thus, at this time, the arm 37'", whose length is unchanging, is no longer held in a position permitting the plate 37' to be horizontal, such that said plate pivots into an oblique position for evacuation of the bag 6. When the arm 37'" again encounters an obstacle of the profile of the cam 14, it is pressed back such that it gives rise to a pivoting of the plate 37' toward the horizontal service position.

The assembly 38 for closing the bags 6 after filling is present in the form of a bearing plate 38' disposed in a shape-mating recess of the pivoting support plate 37', this plate 38' being secured with a pusher 38" guided below the plate 37' in sleeve 40 secured to this latter and bearing with its opposite end by means of a roller 41 or the like against the can 13 of the control device with cams, a compression spring 42, mounted between the sleeve 40 and the end of the pusher 38" carrying the roller 31, ensuring permanent engagement of said pusher 38" against said cam 13. Thanks to this embodiment of the assembly 38, it is possible to ensure holding of the bag 6, on the side opposite the closure 5, to promote the emplacement by pressure of the upper portion of said closure 5 after filling of the bag 6, by means of the sleeve 28 of the manipulation means 7.

Preferably, according to another characteristic of the invention, the guide sleeve 40 of the pusher 38" of the closure assembly 38 forms an integral portion of the actuating arm 37'", this latter being secured to said sleeve 40 eccentrically relative to the axis of the pusher 38" (FIG. 4).

According to another characteristic of the invention, the drive of the filling machine is ensured by means of an electric motor controlled by means of an electronic control circuit. This electronic control circuit is not described in greater detail and makes use of known technology. Thus, the energy necessary for the operation of the machine is used directly without needing supplemental transformation, as is the case for the use of pneumatic actuating means or the like, so that the energy efficiency is higher.

Thanks to the invention, it is possible to provide in a continuous and automatic cycle, a filling of bags, by carrying out the assembly of the operations necessary by means of a control with cams of particularly reliable operation needing no position detecting means. Moreover, this entirely mechanical control permits synchronous operation without the risk of maladjustment over a long operating time.

Moreover, it is possible to carry out at each filling station 3 all the operations relating to the filling of a bag, such that the output of the filling machine can be considerably increased, said operations taking place continuously. There is as a result a great gain of productivity.

Moreover, the provision of a control of all the operations which is substantially exclusively by means of cams, permits great simplification of the construction and operation of the machine, as well as improvement of its reliability, in particular by the reduction of maintenance time, and hence the cost of maintenance.

Furthermore, the productivity of the machine can be improved by taking account of the positive and negative accelerations of the movements of the different elements, so as to optimize the operation of the machine.

Finally, the arrangement of the cams according to the invention gives rise to great compactness of the filling machine whilst avoiding contacts between the mechanical actuating parts, if desired lubricated, and the filling stations, such that conditions of perfect hygiene are guaranteed.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed is:

1. Machine for filling bags or the like, in particular with comestible liquids, essentially constituted by a transfer station (1) rotatable about a central vertical axle (2) mounted on a plate (2') secured to the frame of the machine, by multiple filling stations (3) each comprising a means (4) for gripping and holding the base of a removable closure (5) of a bag (6) and means (7) for manipulating the upper portion of said closure, and by a filling device (8) coacting with the opening of said closure (5) that is open following removal of the upper portion of this latter and supplied with liquid by a pump connected to a reservoir or the like, the assembly of these elements being managed by a control device, characterized in that the control device is a device with cam (9, 14) mounted fixedly on the machine.

2. Machine according to claim 1, characterized in that the cams (9 to 14), adapted for the actuation of the different elements of the machine, are mounted concentrically about the central vertical axle (2) on a plate (2') secured to the frame of the machine and disposed below the rotatable transfer station (1).

3. Machine according to claim 1, characterized in that the cams (9 to 14) are mounted angularly adjustably on the plate (2') secured to the frame of the machine, by coaction with a corresponding lower annular support secured to said plate (2'), the holding in position, after adjustment, of the cams (9 to 14) being ensured by means of screws passing vertically through said cams and coacting with their annular support or by lateral grippers that grip with screws.

4. Machine according to claim 1, characterized in that each filling station (3) is constituted by a pivotable head (29), mounted on a vertical axle (3'), guided on the rotatable transfer station (1) by means of a fixed support (3"), mounted on said station (1), said pivotable head (29) being provided with an eccentric actuating pivot (16) coacting with an assembly of a pusher (11')—an elbowed lever (11")—a rod (11'") actuated by a cam (11) of the device with control by cams.

5. Machine according to claim 4, characterized in that the elbowed lever (11") is mounted pivotably on the transfer station (1) by means of a bearing (15) and is articulatedly connected by its two ends, respectively to one end of the pusher (11") opposite the cam (11) and to one end of the rod (11'"), which is mounted articulatedly on the eccentric actuating pivot (16) of the head (29) of the filling station (3).

6. Machine according to claim 4, characterized in that the pusher (11') is guided on the transfer station (1) by means of a sleeve (18) secured to this latter and is provided at its end coacting with the cam (11) with a bearing roller (17), a spring (19) mounted concentrically on the pusher (11') between the sleeve (18) and a shoulder or a bearing ring located adjacent the roller (17) ensuring permanent contact of this latter with the cam (11).

7. Machine according to claim 1, characterized in that the means (4) for gripping and holding the base of a removable closure (5) of a bag (6) of each filling station (3) is constituted by an assembly of left and right pinchers (4', 4") with differential actuation controlled respectively by cams (10 and 7) of the control device with cams, by means of assemblies of pushers (10', 9')—elbowed levers (10", 9")—rods (10'", 9'").

8. Machine according to claim 7, characterized in that the elbowed levers (10", 9") are articulated on the transfer station (1) by means of respective bearings (23, 22) and the pushers (10", 9") are guided on this transfer station (1) by means of sleeves (21, 20), said pushers being moreover provided, on the one hand, each with a roller (27, 26) for bearing on the respective cams (10 and 9) and, on the other hand, with a compression spring (25, 24) bearing adjacent its end carrying the bearing roller and against the sleeve (21, 20).

9. Machine according to claim 1, characterized in that the means (7) for manipulation of the upper portion of the closure (5) is constituted by a sleeve (28) for gripping the upper portion of the closure (5) mounted on the head (9) of the filling station (3) with the possibility of slight movement parallel to the axle (3') of support of the head (29).

10. Machine according to claim 9, characterized in that the sleeve (28) is mounted on the head (29) by means of a shock absorbing guide assembly (30 to 32) constituted by a sliding axle (30) loaded with a spring (31) and by a guide rod (32) coacting with corresponding guidance of a head (29) and holding the latter against rotation about the axle (30).

11. Machine according to claim 9, characterized in that the sleeve (28) is provided with at least two pinchers with opposed claws (28') each loaded by a return spring in a position of closure of the claws.

12. Machine according to claim 1, characterized in that the axle (3') of each filling station (3), which is guided on the fixed support (3") secured to the transfer station (1), passes through said transfer station (1) and coacts at its free end opposite the head (29) with an annular cam (12) of the control assembly with cams (9 to 14), by means of two lugs or guide rollers (3'") bearing on opposite sides of the annular cam (12).

13. Machine according to claim 1, characterized in that the filling device (8), coacting with the opening of the closure (5), is mounted on the movable head (29) of the station (3) and is pivotably displaceable, together with the means (7) for manipulation of the upper portion of the closure (5), and is present in the form of a hollow body that can be applied in sealed relation against the lower portion of the closure (5), this hollow body being on the one hand connected by a connection (33) to a conduit (34) for connection to the filling pump connected to a reservoir and, on the other hand, provided wit closure means for the connection (33) controlled by a pneumatic jack (35).

14. Machine according to claim 1, characterized in that the transfer station (1) is provided, at each filling station (3), with a means (36) for support, closure and evacuation of the bags (6), which is essentially constituted by a pivoting device (37) for reception of the bags coacting with a control cam (14) and by an assembly (38) for closing the bags (6) after filling, coacting with a control cam (13).

15. Machine according to claim 14, characterized in that the pivoting device (37) for reception of bags coacting with a control cam (14) is present in the form of a pivoting support plate (37') articulatedly mounted on the transfer station (1) by means of a pivoting shaft (37") and by an actuating arm (37'"), secured to the pivoting support plate (37') and coacting at its free end by means of a roller or the like (39), with the cam (14) of the control device with cams.

16. Machine according to claim 14, characterized in that the assembly (38) for closing bags (6) after filling is present in the form of a bearing plate (38') disposed in a shape-mating recess of the pivoting support plate (37'), this plate (38') being secured to a pusher (38") guided below the plate (37') in a sleeve (40) secured to this latter and bearing by its opposite end by means of a roller or the like (41) against the cam (13) of the control device with cams, a compression spring (42), mounted between the sleeve (40) and the end of the pusher (38") carrying the roller (41), ensuring permanent bearing of said pusher (38") against said cam (13).

17. Machine according to claim 15, characterized in that the sleeve (40) for guiding the pusher (38") of the closure assembly (38) is an integral portion of the actuating arm (37'"), this latter being secured to said sleeve (40) eccentrically relative to the axle of the pusher (38").

18. Machine according to claim 1, characterized in that its drive is effected by means of an electric motor controlled by means of an electronic control circuit.

* * * * *